US005975384A

United States Patent [19]

Manabat

[11] Patent Number: 5,975,384

[45] Date of Patent: Nov. 2, 1999

[54] CLOTHES HANGER WITH VARIABLE SIDE ATTACHMENTS

[76] Inventor: Gregorio S. Manabat, 6712 Knott Ave., Apt. 1, Buena Park, Calif. 90621

[21] Appl. No.: 09/118,811

[22] Filed: Jul. 20, 1998

Related U.S. Application Data

[60] Provisional application No. 60/061,518, Oct. 9, 1997.

[51] Int. Cl.[6] ..... A47G 25/48

[52] U.S. Cl. ..... 223/91; 223/96; 223/93

[58] Field of Search ..... 223/85, 88, 92, 223/93, 91, 96

[56] References Cited

U.S. PATENT DOCUMENTS

| | | | |
|---|---|---|---|
| 1,458,066 | 6/1923 | Le Compte | 223/96 |
| 2,517,336 | 8/1950 | Neal | 223/96 |
| 3,744,685 | 7/1973 | Hart . | |
| 4,157,782 | 6/1979 | Mainetti | 223/96 |
| 4,382,531 | 5/1983 | Bisk et al. . | |
| 4,852,777 | 8/1989 | Balkin . | |
| 5,082,152 | 1/1992 | Chen . | |
| 5,082,153 | 1/1992 | Duester et al. . | |
| 5,178,306 | 1/1993 | Petrou | 223/96 |
| 5,297,706 | 3/1994 | Blitz | 223/96 |

*Primary Examiner*—Bibhu Mohanty
*Attorney, Agent, or Firm*—James G. O'Neill

[57] ABSTRACT

A garment hanger is provided with a body supporting a hanger rod between two opposed ends, and the opposed ends support clamps by means of resilient attaching elements to allow the clamps to aid in the securing of a garment on or to the hanger rod. The resilient attaching elements prevent the loss of the clamps, and allow the clamps to aid in supporting garments on the hanger rod, or to be supported on the hanger rod, in various positions, by hooks secured to the clamps.

17 Claims, 8 Drawing Sheets

CLOTHES HANGER WITH VARIABLE SIDE ATTACHMENTS

CROSS REFERENCE TO RELATED APPLICATION

This is a Continuation of co-pending application No. 60/061,518, filed Oct. 9, 1997.

BACKGROUND OF THE INVENTION

1. Field of the Invention

This invention relates generally to clothes hangers, and, more particularly, to a clothes hanger having movable clip means secured thereto by resilient elements to aid in clamping a garment thereto.

2. Description of Related Art

Plastic, wire and wood hangers are well known for hanging various garments in closets, and the like, for display and/or to prevent wrinkling. Many such hangers have movable or rotatable clips or fingers formed thereon to retain various garments by a waistband, pant leg, or other portion of the garment.

Examples of known hangers having movable, resilient or rotatable clips or fingers are set forth in U.S. Pat. Nos. 3,744,685 to Hart, 4,382,531 to Bisk et al., 4,852,777 to Balkin et al., 5,082,152 to Chen and 5,082,133 to Duester et al.

Although these known garment hangers provide improvements in holding garments thereon, there still exists problems of handling and hanging different size garments on such known hangers. Additionally, some persons have difficulties in using the available hangers, or the holding elements thereon. Therefore, there still exists a need in the art for an improved garment hanger, which is more versatile and easier to operate, and which will solve many of the known problems with existing garment hangers.

SUMMARY OF THE INVENTION

It is, therefore, a general object of the present invention to provide an improved garment hanger. It is a particular object of the present invention to provide an improved garment hanger having more easily operated securing means. It is another particular object of the present invention to provide an improved garment hanger which includes securing means attached thereto by resilient elements. It is yet another particular object of the present invention to provide an improved garment hanger having a pair of movable clips which are held to the hanger by lengths of string. And, it is still another particular object of the present invention to provide an improved garment hanger which is easily and quickly used to hold various types of garments of different sizes and shapes thereon, by secured but adjustable and easily movable holding clips.

These and other objects and advantages of the present invention are achieved by providing a garment hanger having a body with a top hook and a hanging rod, together with a pair of movable clamping means held to opposite ends of the hanger body by elongated resilient elements connected between the clamping means and the opposite ends so as to be able to support various portions of garments on or to the hanging rod of the hanger, in selected positions.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved garment hanger for use in easily and quickly supporting garments thereon, in a more efficacious manner.

Figure 1:
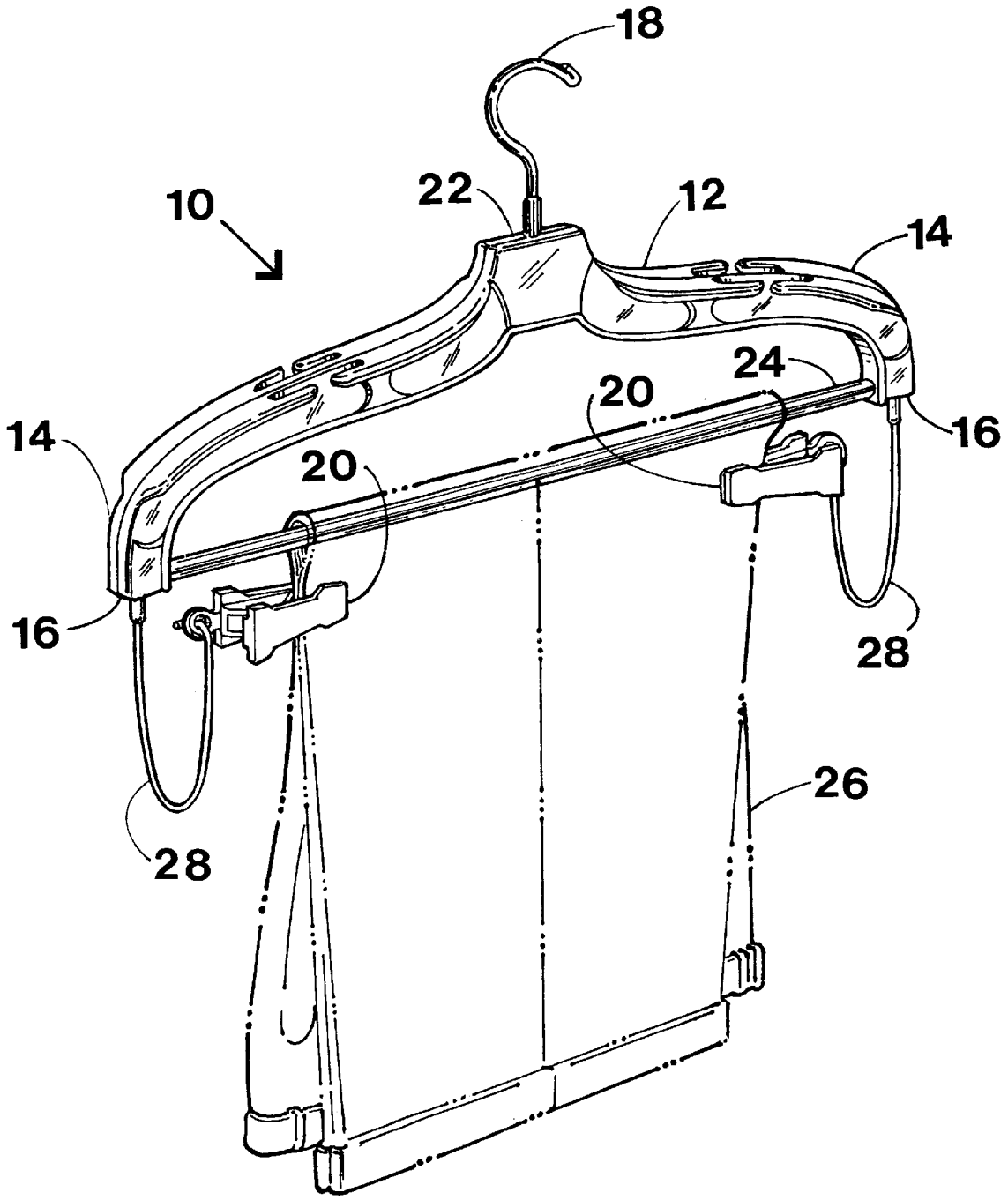
FIG. 1 is a perspective view showing one embodiment of the improved garment hanger of the present invention, holding a pair of pants thereon.
Figure 2:
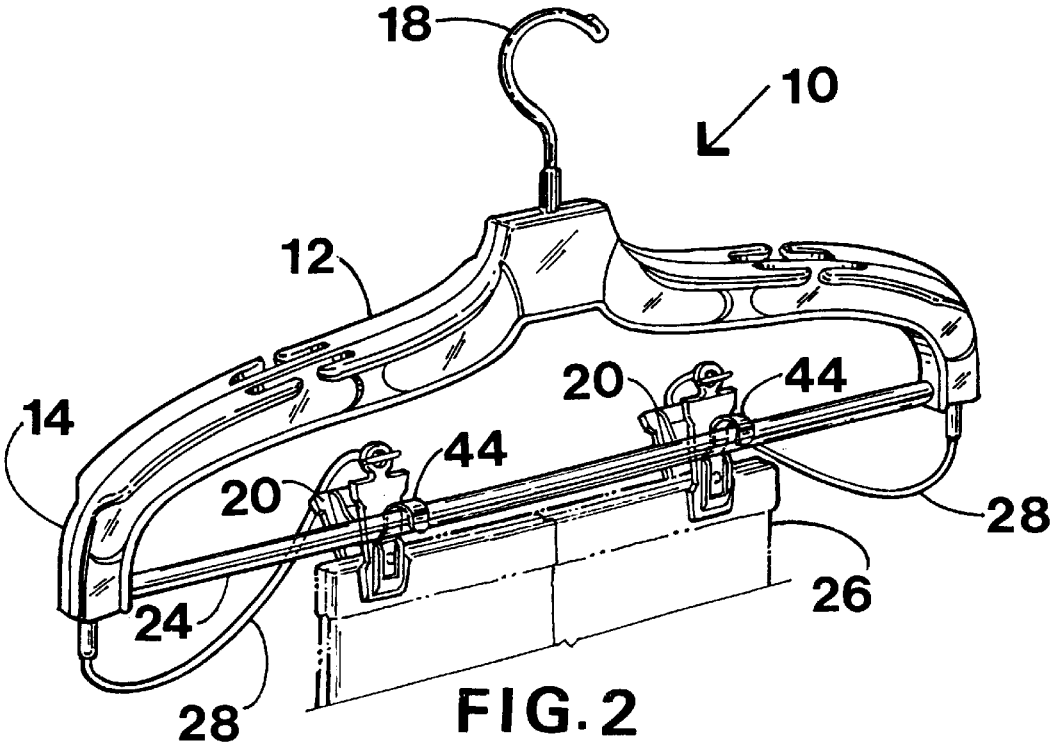
FIG. 2 is a further perspective view of the garment hanger of FIG. 1, with holding means supporting pants therefrom, in a different position.

Turning now to the drawings, and particularly FIGS. 1 and 2, there shown is a first embodiment of the garment hanger of the present invention, generally indicated at 10. The hanger 10 is shown as having a body 12 and a pair of shoulders 14, terminating in flat ends 16. The body 12 is constructed mostly from rigid plastic material, with the exception of a swivel wire hook 18 and some parts of clamping means 20, which will preferably be made of metal. While this description suggests a clothes hanger constructed from plastic material, it should be understood by those skilled in the art, that other materials may also be suitable to use, and that the use of plastic material as an example, is not limiting in how the garment hanger 10 of the present invention may be manufactured. Furthermore, since the clamping means 20 that are shown and used herein are identical, the description of one will be sufficient for all.

The main body 12 of the hanger 10 has left and right sloping free-form shapes having shoulders 14 and flat ends 16. An apex 22 is preferably made flat and measures about two inches (2") in width. At the center of this flat apex 22 is a revolving wire hook 18, which can swivel 360°. Bridging the two shoulders 14 of the hanger 10, and securely held therein, is a support rod 24, which is approximately ⅜" in diameter. Each end 23 of the rod 24 is reduced in diameter to about ¼" for about 3/16" in length, and acts as a dowel when permanently joined together with the main body 12.of the hanger adjacent the ends 16. A pair of pants or trousers 26 are shown supported on rod 24, and secured in place by a pair of clamping means 20. The clamping means 20 are permanently or releasably secured in the flat ends 16 of the hanger 10, by means of elongated, resilient attaching elements or means 28, such as flexible strings, or the like.

Figure 3:
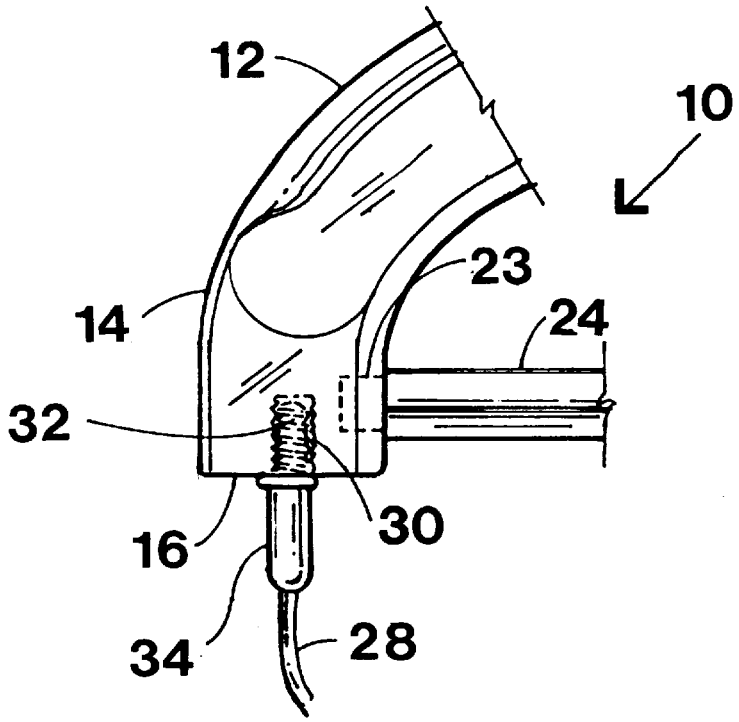
FIG. 3 is an enlarged partial front elevational view of one end of a garment hanger of the present invention, showing how a resilient holding element may be threadedly held in an end of the hanger.
Figure 3A:
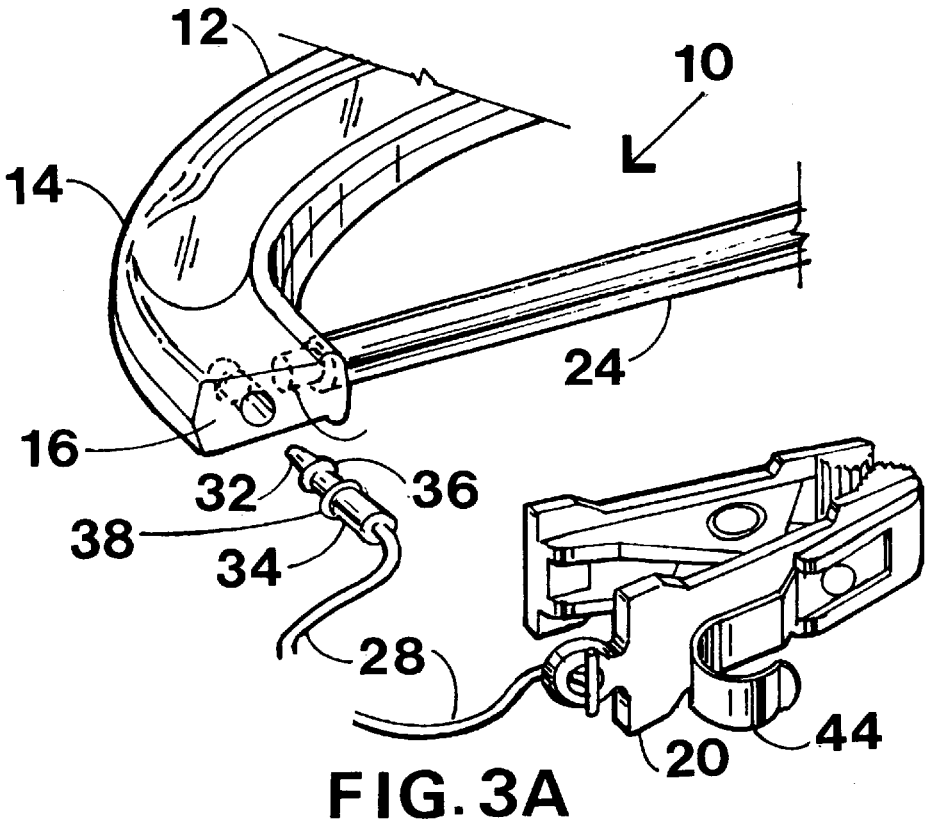
FIG. 3A is an enlarged partial perspective view showing how a clamp holding means may have one end of an attachment means removably held in one end of the hanger of the present invention.
Figure 3B:
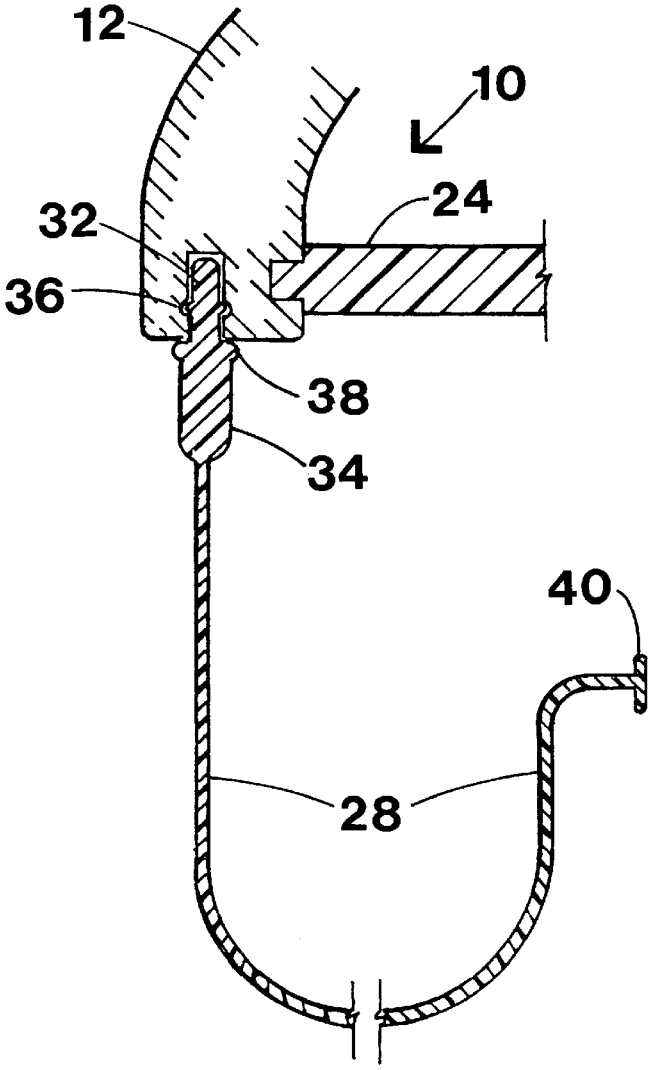
FIG. 3B is an enlarged, partial, cross-sectional view of the attachment means held in one end of the hanger of the present invention.

As best shown in FIGS. 3 and 3A, the flat ends 16 of the hanger 10 may have openings 30, approximately ⅛" in diameter and about ½" deep formed therein. These openings 30 are sized and dimensioned to receive holding elements 32, such as a prong, which may be inserted into and removably held in openings 30 by a handle, or cap 34. The prong 32 is preferably shaped like a bullet approximately 5/32" in diameter at an outer end, with one small, resilient holding ring 36 formed around the prong. Approximately 3/16" thereafter a larger ring 38 about 5/16" in diameter and about ⅛" wide is formed so as to encircle the diameter of handle 34. The handle or cap 34 is about ¼" in diameter. The outer end of this handle 34 is cylindrical, and is connected to a first end of the resilient attaching means 28. The resilient attaching means 28 may be made of a resilient plastic or other resilient material of good tensile strength. The elongated, resilient attaching elements 28 is preferably about 3/32" in diameter and about 8" in length. The second or outer end of the attaching element 28 is preferably formed so as to have a securing element 40, such as a T-shaped configuration formed thereon (see FIG. 8). The bullet-shaped prong 32, the rings 36, 38, the shaft-handle 34, the resilient attaching element 28 and the securing element 40 are preferably constructed as a single unit.

Figure 7:
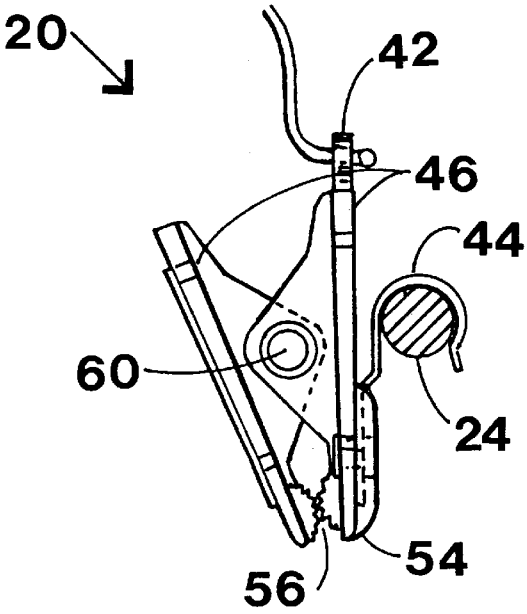
FIG. 7 is a side elevational view of the clamp holding means shown in FIG. 6 held on a hanger rod.
Figure 8:
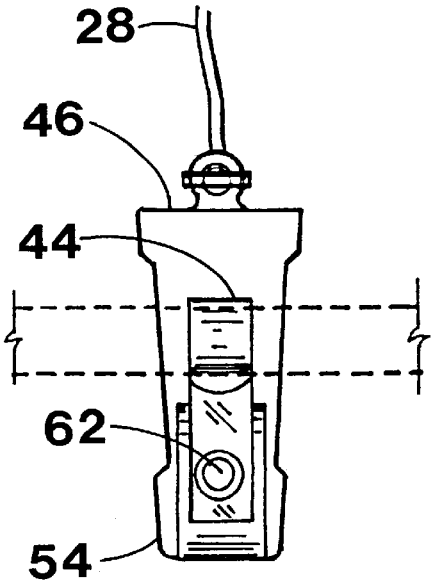
FIG. 8 is a rear elevational view of the clamp holding means shown in FIG. 6.
Figure 9:
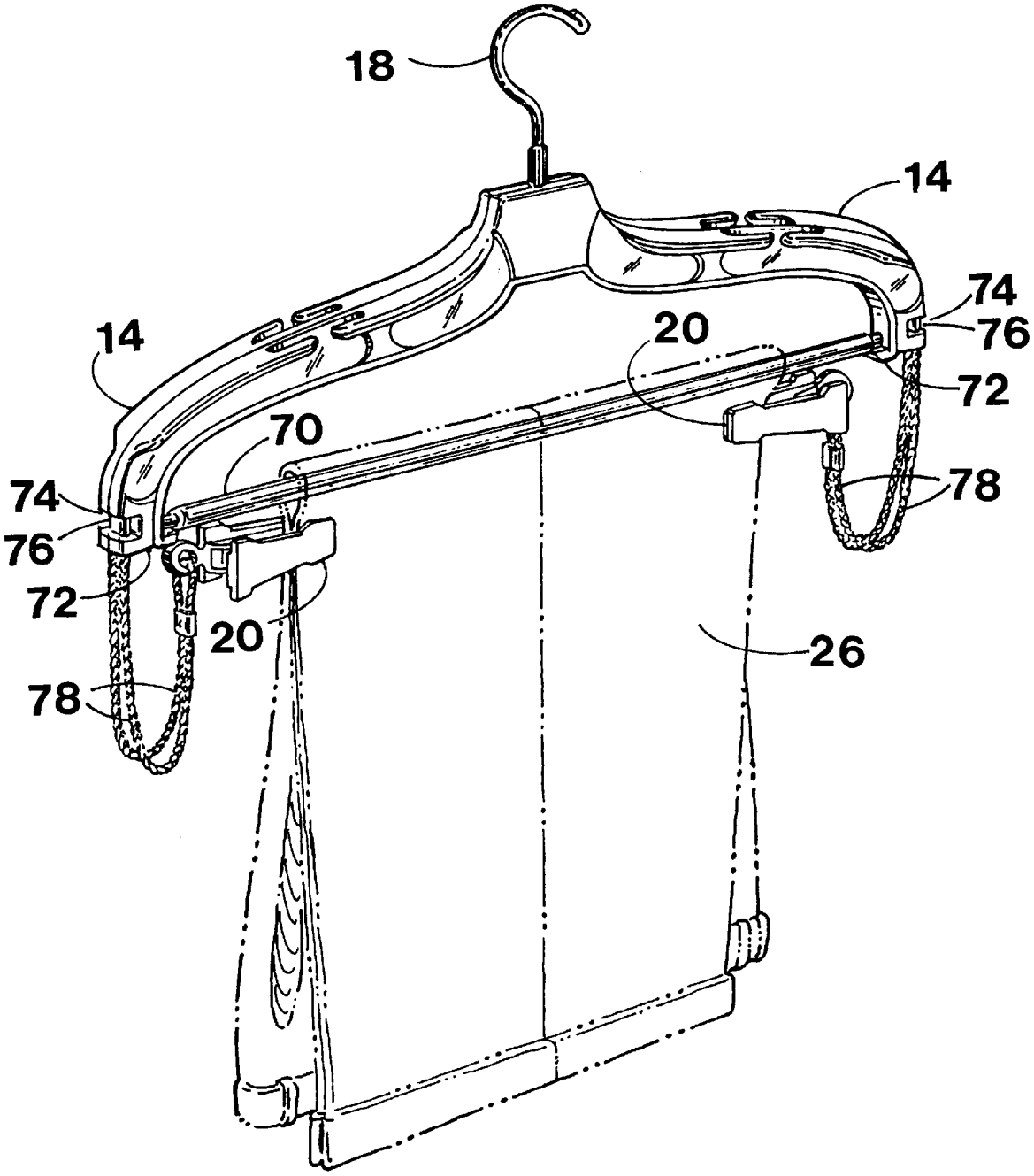
FIG. 9 is a perspective view of a further embodiment of the garment hanger of the present invention.
Figure 10:
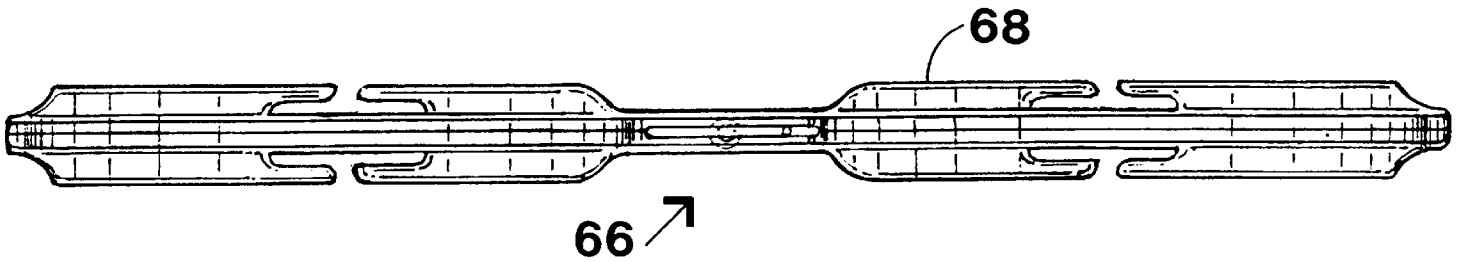
FIG. 10 is a top plan view of the hanger of FIG. 9.
Figure 12:
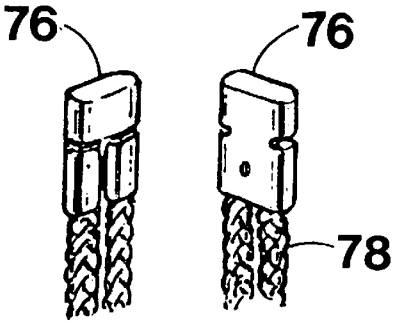
FIG. 12 is a perspective view of secured or swagged ends of elongated attachment means, for clamp holding means, such as those secured in opposite ends of the hanger of FIG. 9.
Figure 11:
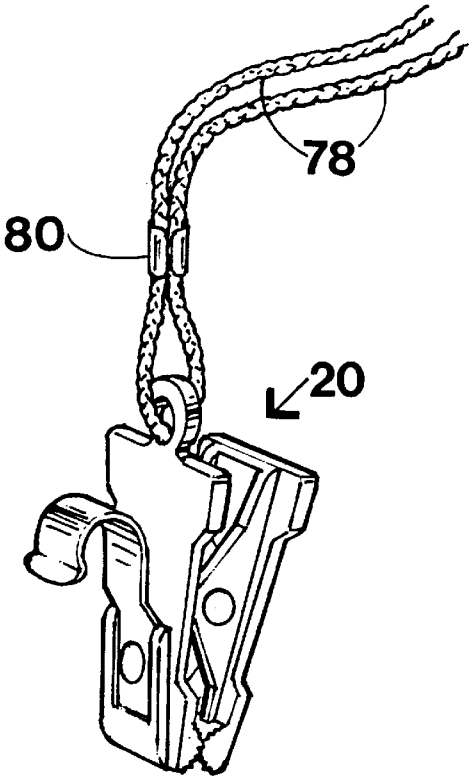
FIG. 11 is a perspective view of a clamp holding means having an elongated attachment means looped through a top opening.
Figure 13:
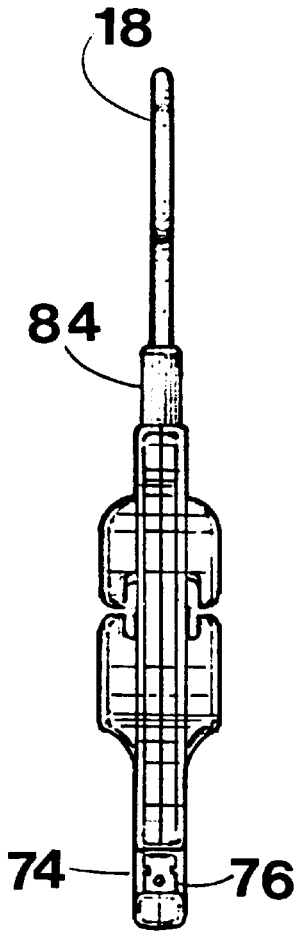
FIG. 13 is a side elevational view of the hanger of FIG. 9.
Figure 14:
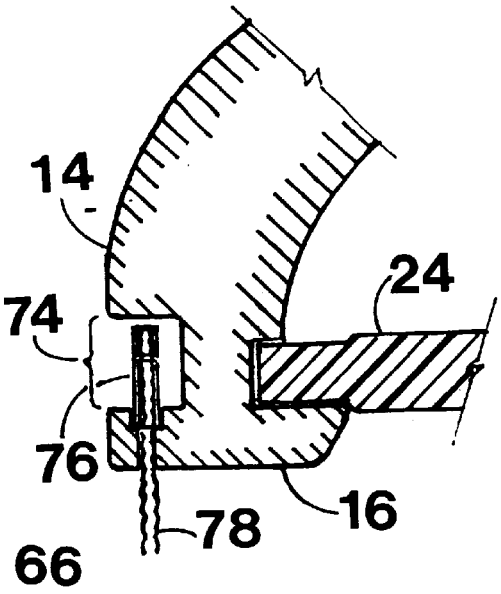
FIG. 14 is an enlarged partial front elevational view of one end of the garment hanger of FIG. 9, showing an opening therein for holding one of the elongated attachment means in position.
Figure 15:
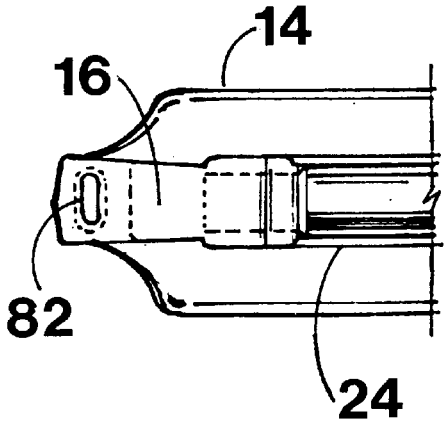
FIG. 15 is a bottom plan view of FIG. 14.

As best shown in FIGS. 3A, 7 and 8, when connecting the attaching elements 28 to the clamps 20, the securing element 40 must be bent so that it is almost parallel with the string. While it is in this position, the securing element 40 is inserted through an opening in eye 42, which is formed at one end of a wing handle 46 of each clamp 20. The opening in the eye 42 is large enough to receive the securing element 40, when bent parallel to the string 28. After passing through the opening 42 to the opposite side thereof, the securing element 40 of the string 20 is allowed to return to its normal position, thereby completing the connection (as shown in FIGS. 3A, 7 and 8).

Those skilled in the art will understand that the joining of the attaching means 28 and clamps 20 to the hanger body 12 will not be limited to the method described above. A further example of how this can be accomplished is shown in FIG. 3, where a threaded member 32' is secured into a threaded opening 30' to hold the handle member 34 securely in the flat end 16 by the screw threads, instead of resiliently holding the same in place, as previously mentioned.

Figure 4:
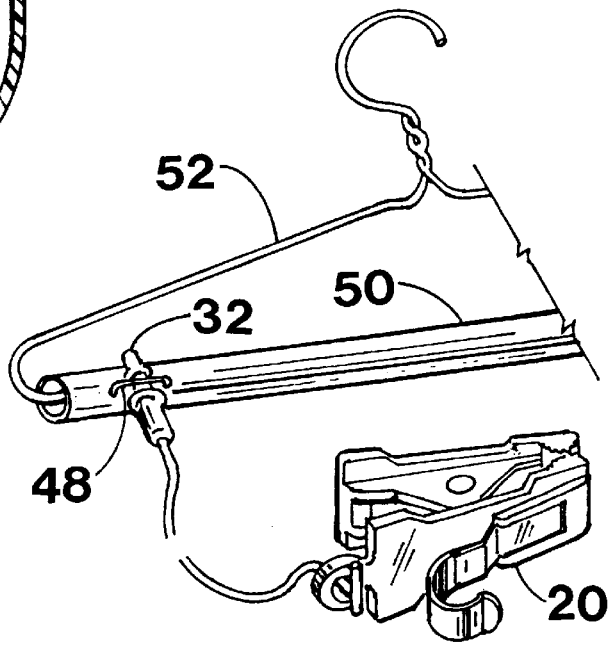
FIG. 4 is a partial perspective view showing how a clamp holding means may be attached to a cardboard rod of a wire clothes hanger by its attachment means.
Figure 5:
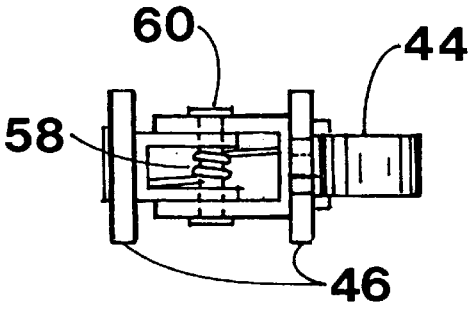
FIG. 5 is a top plan view of one of the clamp holding means of the present invention.
Figure 6:
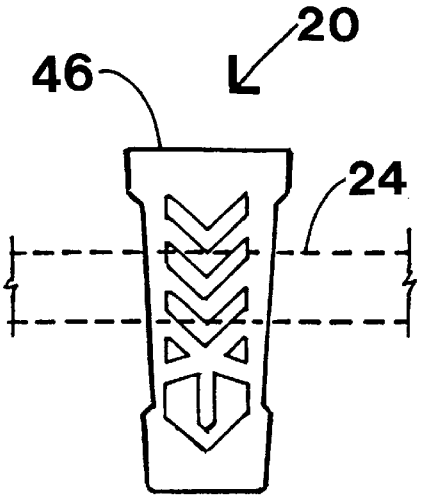
FIG. 6 is a front elevational view of the clamp holding means of FIG. 5.

The main purpose of this idea of the quick connect and disconnect attribute of the handle members and ends of the elongated, resilient attaching elements 28, holding the clamps 20 to the hanger body 12, is to achieve versatility. However, when the ends of the elongated, resilient attaching elements 28 are disconnected from the ends 16, the hanger 10 may still be used, while the attachment means comprised of 20, 28, 32 and 34 can also be used, for example, as shown in FIG. 4. In this illustrated example, a regular wire staple 48 is pressed around the string 28 for attachment to a cardboard rod 50 of an ordinary wire hanger 52 to achieve temporary but effective unison. With such an attachment, the ordinary wire hanger 52 may be reused.

FIGS. 5–8 illustrate one embodiment of clamps 20, comprised of two (2) movable jaws 54, having two (2) sets of teeth 56, two (2) wing-handles 46, a metal spring 58 and an axial metal rod 60. Joined to one of the wing-handle 46 of the clamp 20, which is preferably constructed from a rigid plastic material, such as polypropylene, is a hook means 44, preferably made from stainless steel or the like. The hook means 44 is approximately ⅜" wide, and has a body of the same width. The bottom face portion of the wing-handle 46, which contains the hook means 44, is shaped and molded to have a groove which holds the body of the hook to prevent it from being dislodged. Once the body of the hook 44 is in place in the groove, it is then attached permanently thereto by a fastener 62, made from metal, or the like.

Figure 2A:
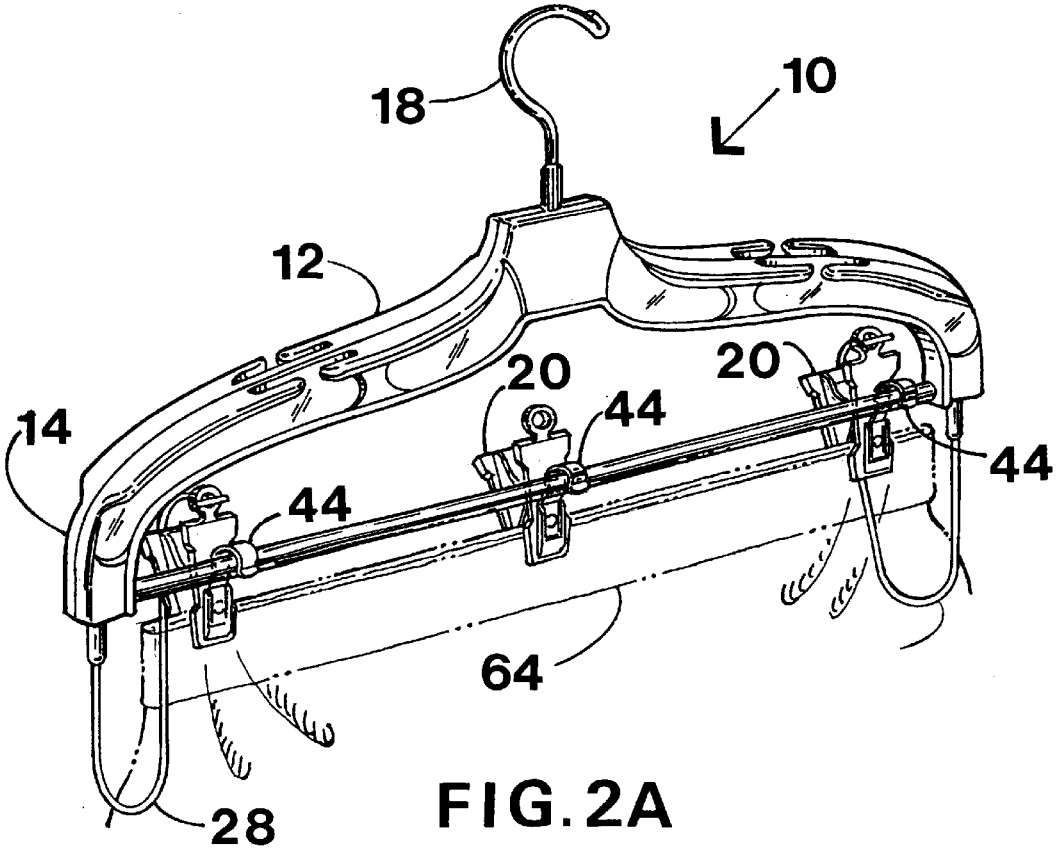
FIG. 2A is a further perspective view of the garment hanger of FIG. 1, supporting a large garment thereon, by a pair of end holding means, as well as a third holding means, supported centrally on the garment hanger.

In operation, as shown in FIG. 1, both clamps 20 are secured by their respective elongated resilient attaching means 28 to ends 16, and can grip opposite ends or sides of a pair of folded trousers 26 hanging on rod 24, to further secure the trousers on the rod 24 and thereby prevent them from slipping off the rod. FIG. 2 illustrates how the clamps 20 may be supported on the hanging rod 24, by hooks means 44, and hold the ends or leg-cuffs of pants 26, thereby displaying the supporting the full length of the trousers. Because the clamps 20 are secured by their respective elongated resilient attaching means 28 to ends 16, each clamp 20 may be easily moved to aid in securing different sized garments, and the like, hung on or supported by the rod 24. As shown in FIG. 2A, a wide garment 64 hung on the rod 24, and which would have a tendency to sag and/or crumple in the middle, if only two clamps 20 are used, may have one or more loose clamps 20, minus the attaching means 28 thereon, hung on rod 24 by hooks 44, to further secure the garment 64.

Turning now to FIGS. 9–15, there shown is a still further embodiment of the invention, comprised of a hanger 66, having a body 68 supporting a hanging rod 70 between two ends 72, and a hanging hook 18, held in a loose ring 84. Each of the ends 72 has a notched opening 74 formed therein, and secured together or swagged ends 76 of an elongated attachment or looped means 78 are inserted and held in these notched openings. The other or looped end of the looped means 78 passes through and is held in eye 42 of a clamping means 20. The looped means 78 are preferably formed by first passing a loose end thereof through the eye 42 of the clamping means 20. The loose ends of looped means 78 are then brought together and inserted into an opening 82 in the ends 72 (see FIG. 15), until they are aligned in the notched openings 74. The aligned loose ends of the looped means 78 are then swagged, or otherwise secured together, as shown at 76. Means, such as a crimp element 80, may be provided in the looped means 78 to secure the sides thereof together, or to adjust the length thereof, so as to provide clamps 20, having variable length attaching means 78, securing them to the ends 72 of the hanger body 68.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An improved garment hanger comprising a body with a top apex having a wire hook secured therein, a pair of shoulders and a pair of ends;

a hanging rod supported between the pair of ends;

a first clamping means secured to one of the pair of ends by a first elongated, resilient attachment means;

a second clamping mean secured to another of the pair of ends by a second elongated resilient attachment means;

a first hook element on the first clamping means and a second hook element on the second clamping means to enable the first clamping means and the second clamping means to be releasably supported, in various positions, on the hanging rod by the first hook element and the second hook element.

2. The improved garment hanger of claim 1 wherein the elongated, resilient attachment means are resilient strings elements secured between the pair of ends and an eye formed on the first clamping means and the second clamping means.

3. The improved garment hanger of claim 2, further including separate, unattached clamping means having a hook element thereon, releasably supported on the hanging rod, by the hook element.

4. The improved garment hanger of claim 2 wherein the resilient string elements are releasably secured in the pair of ends.

5. The improved garment hanger of claim 2 wherein the resilient string elements are secured in the pair of ends by threaded elements.

6. The improved garment hanger of claim 1 wherein the first clamping means and the second clamping means are secured to a selected one of the pair of ends in a flattened portion thereof.

7. The improved garment hanger of claim 6 wherein each of the first clamping means and the second clamping means are comprised of two wing handles, held together by an axial rod, and one of the two wing handles includes an opening formed therein, which opening holds an outer end of the elongated, resilient attachment means therein; and wherein each of the wing handles having the opening therein also includes the first hook element or the second hook element secured thereon.

8. A garment hanger comprising:

a body with a top apex having a wire hook rotatably secured therein, a pair of shoulders and a pair of ends;

a hanging rod supported between the pair of ends;

a first clamp secured to a first of the pair of ends;

a second clamp secured to a second of the pair of ends;

first and second elongated, resilient securing elements securing the first clamp and the second clamp to the pair of ends, to aid in supporting a garment from the hanging rod; and the first clamp and the second clamp including hook elements thereon to enable the first clamp and the second clamp to be releasably supported, by their respective hook elements, on the hanging rod.

9. The improved garment hanger of claim 8 wherein the first and second elongated, resilient securing elements are resilient strings elements secured between the pair of ends and eyes formed on the first clamp and the second clamp.

10. The improved garment hanger of claim 9, further including a separate, unattached clamp having a hook thereon for use in holding large garments on the hanging rod, by means of the hook held on the hanging rod.

11. The improved garment hanger of claim 9 wherein the resilient strings elements are releasably secured in the pair of ends.

12. The improved garment hanger of claim 9 wherein the resilient string elements are secured in the pair of ends by a threaded element.

13. The improved garment hanger of claim 8 wherein the first clamp and the second clamp are comprised of two wing handles, held together by an axial rod, and one of the two wing handles includes an opening formed therein, which opening holds an end of one of the elongated, resilient securing means therein; and wherein the one of the two wing handles also includes one of the hook elements thereon.

14. An improved garment hanger comprising:

a body with a top apex having a wire hook rotatably secured therein, first and second free formed shoulders, a first flattened end and a second flattened end;

a hanging rod supported between the first flattened end and the second flattened end;

a first clamping element secured to the first flattened end and a second clamping element secured to the second flattened end;

a first elongated, resilient attaching element securing the first clamping element to the first flattened end;

a second elongated, resilient attaching element securing the second clamping element to the second flattened end; and the first clamping element and the second clamping element including hook elements held thereon to enable the first clamping element and the second clamping element to be releasably supported on the hanging rod, in various positions, by their respective hook elements.

15. The improved garment hanger of claim 14 wherein the first elongated, resilient securing element and the second elongated, resilient element are elongated strings; and each of the elongated strings is secured between the first flattened end and the second flattened end and an eye formed on the first clamping element and the second clamping element.

16. The improved garment hanger of claim 15 wherein the elongated strings are secured in the first flattened end and the second flattened end by a prong shaped element secured at one end of the elongated strings.

17. The improved garment hanger of claim 14 wherein the first elongated, resilient securing element and the second elongated, resilient element are looped elongated elements secured between an opening in the first flattened end and an opening in the second flattened end and an eye formed on the first clamping element and the second clamping element; and wherein the elongated looped elements include secured together ends held in the opening in the first flattened end and the opening in the second flattened end.

* * * * *